US005664504A

United States Patent [19]

Kobayashi

[11] Patent Number: 5,664,504

[45] Date of Patent: Sep. 9, 1997

[54] COMBUSTION APPARATUS HAVING INVERSE TEMPERATURE DISTRIBUTION BY FORCED CONVECTION

[76] Inventor: Shizuo Kobayashi, 18-10, Matunuma-cho, Tatebayashi-shi, Gunma, Japan

[21] Appl. No.: 358,924

[22] Filed: Dec. 19, 1994

[30] Foreign Application Priority Data

Oct. 27, 1994 [JP] Japan ..... 6-286179

[51] Int. Cl.[6] ..... F23G 5/00

[52] U.S. Cl. ..... 110/251; 110/190; 110/245

[58] Field of Search ..... 110/190, 193, 110/179, 243, 244, 251, 258, 259, 315, 316, 116, 105

[56] References Cited

FOREIGN PATENT DOCUMENTS

| | | |
|---|---|---|
| 50-114179 | 4/1975 | Japan . |
| 57-183434 | 4/1982 | Japan . |
| 57-155364 | 9/1982 | Japan . |
| 57-155365 | 9/1982 | Japan . |
| 57-155366 | 9/1982 | Japan . |
| 58-60113 | 4/1983 | Japan . |
| 58-60114 | 4/1983 | Japan . |
| 56-60112 | 4/1988 | Japan . |
| 63-36821 | 6/1988 | Japan . |
| 3-279705 | 12/1991 | Japan . |
| 3-279706 | 12/1991 | Japan . |
| 3-279707 | 12/1991 | Japan . |
| 4-280979 | 10/1992 | Japan . |
| 4-280980 | 10/1992 | Japan . |
| 4-280981 | 10/1992 | Japan . |
| 5-8222 | 1/1993 | Japan . |
| 5-18520 | 1/1993 | Japan . |
| 5-18521 | 1/1993 | Japan . |
| 5-18522 | 1/1993 | Japan . |

*Primary Examiner*—Henry A. Bennett
*Assistant Examiner*—Susanne C. Tinker
*Attorney, Agent, or Firm*—Townsend and Townsend and Crew LLP

[57] ABSTRACT

A combustion apparatus includes a combustion chamber having a bottom portion, and a blower for supplying air. An air blowing section is provided at a lower portion of the combustion chamber and blows out the air supplied from the blower toward the bottom portion. As a result, air is moved toward the bottom portion in the center portion of the lower portion of the combustion chamber in a radius direction and combustion gas rises upwardly along a wall of the combustion chamber. Therefore, a maximum combustion temperature portion is confined in the vicinity of the bottom portion by a forced air flow. Also, the combustion temperature in the lower portion of the combustion apparatus is high and that in the upper portion thereof is low. That is, the combustion temperature distribution is inverted, compared to that in the conventional combustion apparatus. For instance, the air blowing section includes a reception section having at least one first opening provided on a wall of the combustion chamber and a detachable circular pipe with at least one bridge pipe corresponding to the at least one first opening. The bridge pipe is connected to the first opening. The circular pipe has at least one second opening on its lower surface, and is provided above a central portion of the bottom portion to blow out the air supplied from the blower through the first opening, from the second opening toward the bottom portion.

29 Claims, 10 Drawing Sheets

Fig. 7A
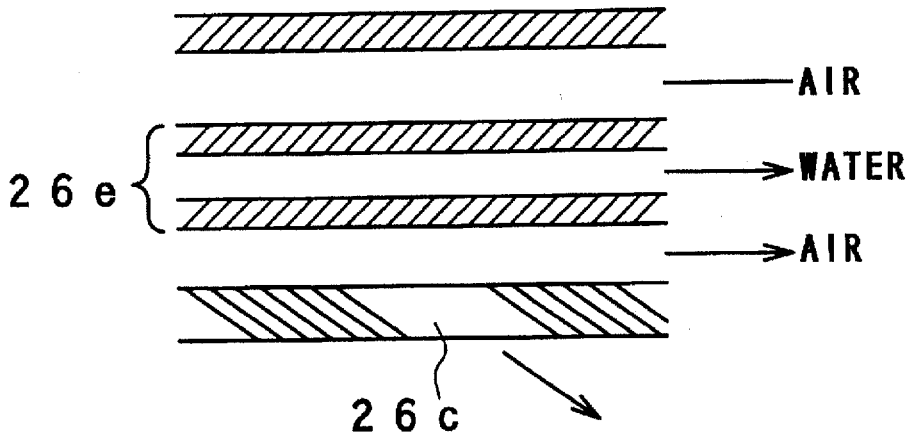
Fig. 7B
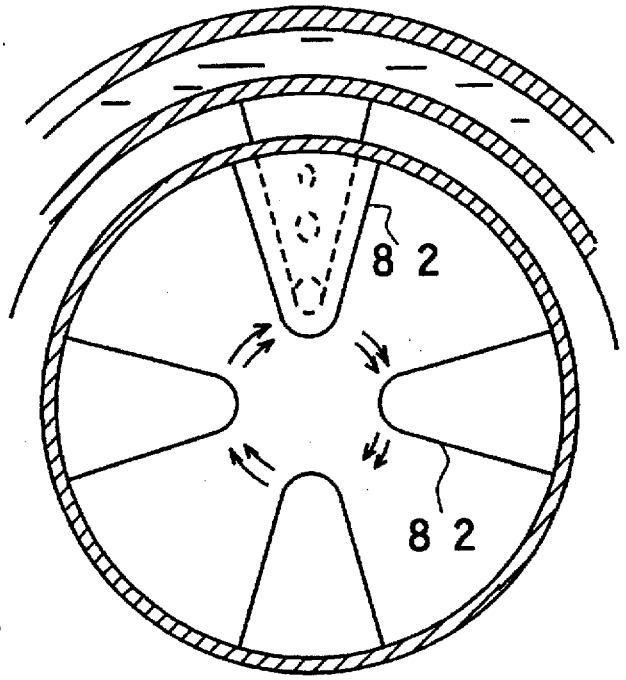
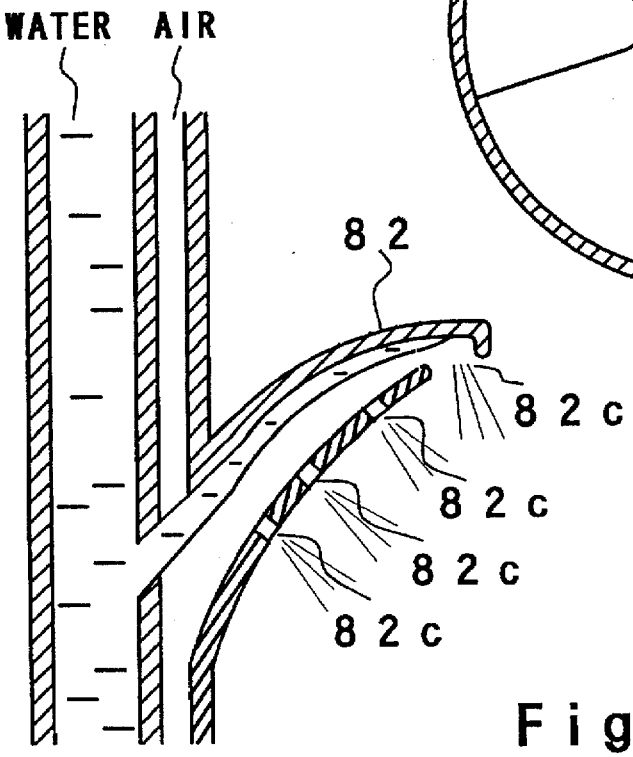
Fig. 7C

COMBUSTION APPARATUS HAVING INVERSE TEMPERATURE DISTRIBUTION BY FORCED CONVECTION

BACKGROUND OF THE INVENTION

1. Field of the Invention

The present invention relates to a combustion apparatus, and more particularly, to a combustion apparatus having an inverse temperature distribution by forced convection.

2. Description of the Related Art

Recently, the problem of waste treatment has risen from the view point of prevention of environment pollution. The problem of waste treatment is that it is difficult to reserve a wide area required when the waste is buried. Also, in a case where the waste is oil, if the wasted oil is buried together with another kind of waste such as kitchen refuse, it possibly contaminates water source. When the waste is burned, another problem is caused. In this case, the amount of waste can be reduced, which is very convenient. However, exhausted gas, such as harmful nitrogen oxide gas, and halide gas, pollutes the ambience. In order to burn waste such as plastics, it is necessary to employ high temperature combustion, resulting in the damage of a combustion apparatus, so that the life of the combustion apparatus is shortened. For instance, in a case of treatment of wasted tires, various types of combustion apparatus have been conventionally proposed. However, any type of incinerator was of small size and had a low calorific value and did not satisfy the condition that it should never cause pollution. When the wasted tire is directly burned, the combustion temperature is very high because the main component of the tire is gum. For this reason, damage of the combustion apparatus is remarkable. Also, a noxious odor is dispersed because various kinds of gas are generated and carbon component of the tire is not sufficiently burned so that it is exhausted as carbon black.

FIG. 1 shows an example of the combustion apparatus of direct burning system such as an incinerator. In the combustion apparatus of direct burning system, the waste to be burned such as the wasted tire is ignited after it is thrown into the combustion apparatus, and the waste starts to burn. Although not shown in the figure, air is supplied from the bottom of the combustion apparatus. In this case, usually, an amount of air is not sufficient. As the waste burns, the flame rises from the lower portion of the combustion apparatus toward the upper portion thereof. At this time, the combustion temperature distribution in the inside of the combustion apparatus is about 600° C. in the lower portion, about 800° C. in the middle portion, and about 1200° C. in the upper portion of the combustion apparatus. As seen from the above, the complete combustion occurs only in the uppermost portion of the waste to be burned and the portions of the waste other than the uppermost portion are in the incomplete combustion state. For this reason, the carbon component such as the carbon black is exhausted together with combustion gas from the portions in the incomplete combustion state.

As described above, if the waste is intended to be burned by the conventional combustion apparatus of direct burning system, the resulting problems of ambient pollution and noxious odors will occur. Also, if the waste such as plastics is burned, the combustion apparatus is damaged because of the high temperature combustion, resulting in the shortened life of the combustion apparatus.

SUMMARY OF THE INVENTION

An object of the present invention is to provide a combustion apparatus which can combust object to be burned without exhausting smoke.

Another object of the present invention is to provide a combustion apparatus which can suppress the concentration of harmful exhausted gas.

A further object of the present invention is to provide a combustion apparatus which can completely combust the object to be burned so that smoke can be exhausted.

Yet another object of the present invention is to provide a combustion apparatus in which a high temperature portion upon combustion is confined in the lower portion of a combustion chamber of the combustion apparatus such that the object to be burned is completely combusted.

A yet another object of the present invention is to provide a combustion apparatus in which convection toward the bottom portion of the combustion apparatus in the middle portion in a radial direction is caused such that object is completely combusted.

It is also an object of the present invention to provide a combustion apparatus in which air is supplied toward the bottom portion of the combustion apparatus in the vicinity of the bottom portion such that the combustion temperature in the lower portion of the combustion apparatus is higher than those in other portions thereof to perform complete combustion for the object to be burned.

In one aspect of the present invention, a combustion apparatus includes a combustion chamber having a bottom portion, a blower for supplying air, and air blowing means provided at a lower portion of the combustion chamber, for blowing out the air supplied from the blower toward the bottom portion such that a maximum combustion temperature portion is confined in the vicinity of the bottom portion by a forced air flow.

In another aspect of the present invention, a combustion apparatus such as an incinerator includes a combustion chamber having a bottom portion, and convection means for making convection to occur in the vicinity of the bottom portion by a forced air flow, such that air is moved toward the bottom portion in the center portion of the lower portion of the combustion chamber in a radial direction and combustion gas rises upwardly along a wall of the combustion chamber.

In this manner, the maximum temperature portion of combustion is confined in the lower portion of the combustion chamber of the combustion apparatus. Therefore, the combustion temperature in the lower portion of the combustion apparatus is high and that in the upper portion thereof is low. That is, the combustion temperature distribution is inverted, compared to that in the conventional combustion apparatus.

The air blowing means may include air path means for passing the air from the blower, and a circular pipe having at least one opening on its lower surface, provided above a central portion of the bottom portion, and connected to the air path means, for blowing out the air supplied from the blower through the air path means, from the opening toward the bottom portion.

Alternatively, the air blowing means may includes air path means for passing the air from the blower, and a plurality of protection portions having at least one opening on its lower surface, provided on an inner wall of the combustion chamber at a lower portion of the combustion chamber, and connected to said air path means, for blowing out the air supplied from the blower through the air path means, from the opening toward the bottom portion.

Further, the air blowing means may include air path means for passing the air from the blower to at least one first opening provided on a wall of said combustion chamber, and a detachable circular pipe with at least one bridge pipe corresponding to the at least one first opening, the bridge pipe being connected to the first opening, wherein the circular pipe has at least one second opening on its lower surface, and is provided above a central portion of the bottom portion to blow out the air supplied from the blower through the air path means, from the second opening toward the bottom portion.

The air blowing means may be subjected to a baking finish of alminium or ceramic coating for increasing heat resistivity, and thereby resulting in the long life of the combustion apparatus. Alternatively, the air blowing means may be cooled by cooling water by employing a double pipe structure or contact with the cooling water.

The combustion apparatus may further include at least one temperature detector means for detecting a combustion temperature, and control means for controlling the blower to change an amount of air to be supplied in accordance with the detected combustion temperature. Thus, the combustion temperature can be optimized to achieve the long life of the combustion apparatus without almost exhausting harmful gas and smoke.

In a case that an entrance has a tapered portion, a user can easily throw the object to be burned into the combustion apparatus via the entrance, and the entrance may be provided with an air curtain which can prevent the flame from blowing out from the entrance.

BRIEF DESCRIPTION OF THE DRAWINGS

FIGS. 7A, 7B and 7C are schematic cross sectional views showing a part of a modification of the air blowing section, a schematic top plan view diagram and cross sectional view diagram of another modification of the air blowing section, respectively;

DESCRIPTION OF THE PREFERRED EMBODIMENTS

The combustion apparatus such as an incinerator according to the present invention will be described below in detail with reference to the accompanying drawings.

Figure 1:
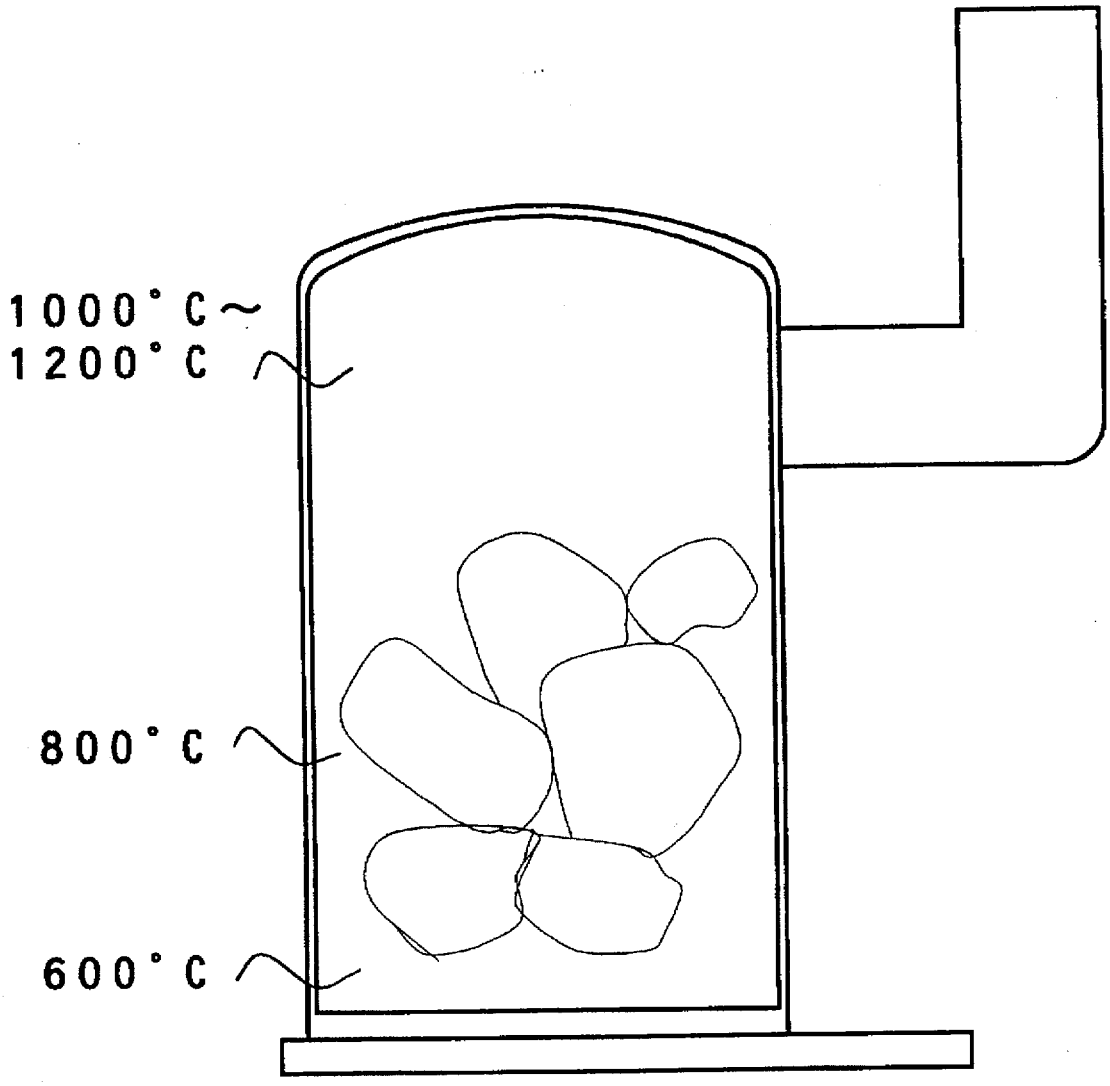
FIG. 1 is a schematic diagram showing the combustion temperature distribution in a conventional combustion apparatus.
Figure 2:
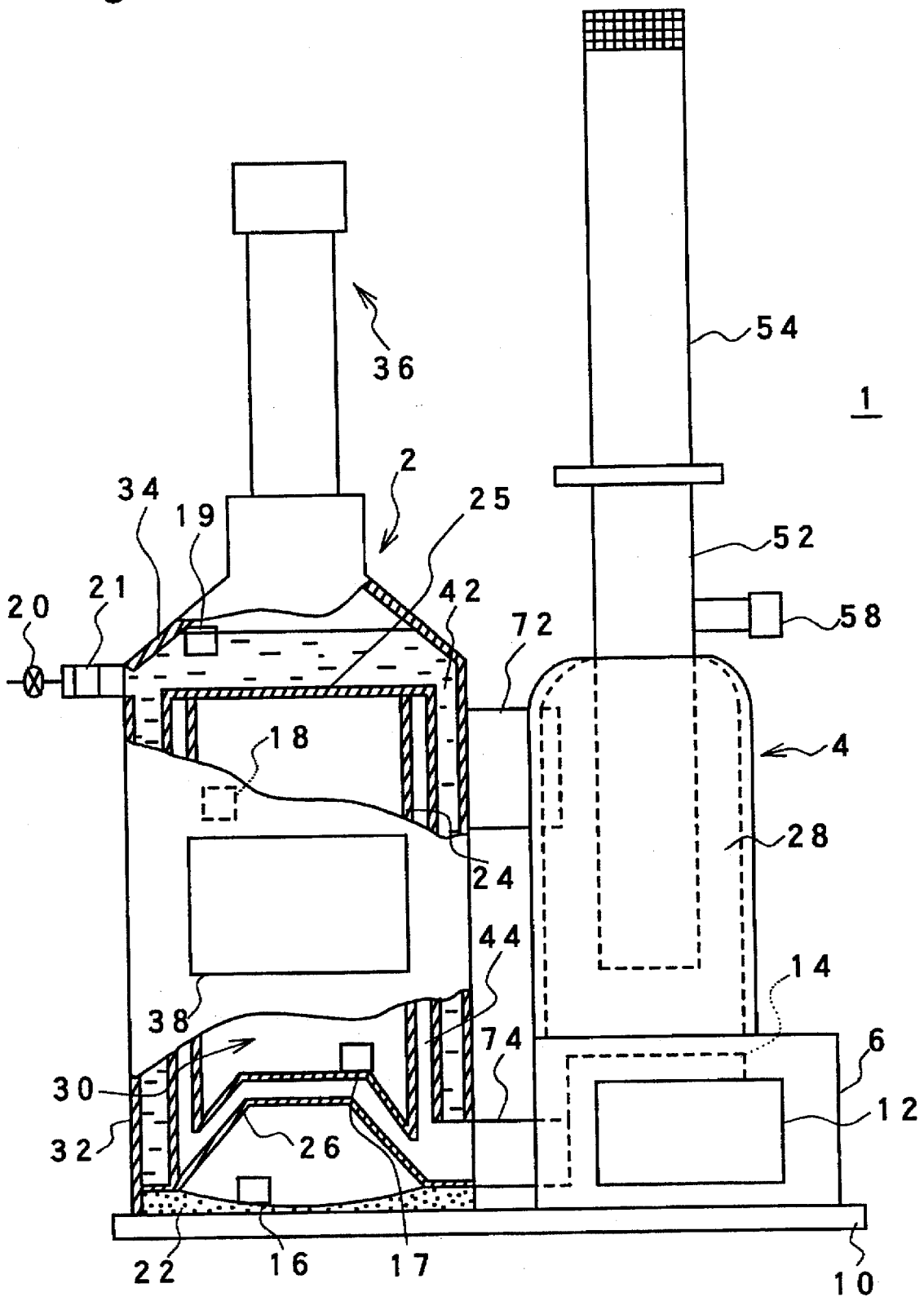
FIG. 2 is a schematic front view diagram showing a combustion apparatus according to an embodiment of the present invention with a partial cross sectional view.

FIG. 2 is a diagram schematically showing the combustion apparatus 1 according to the first embodiment of the present invention. The combustion apparatus 1 is illustrated with an arbitrary cross section in partial. The combustion apparatus 1 mainly includes a blower chamber section 6, a combustion chamber section 2, a dust collector section 4. The blower chamber section 6 and the combustion chamber section 4 are connected to each other by a thick air supply path 74 and the combustion chamber section 4 and the dust collector section which is provided on the blower chamber section 6 are connected to each other by a gas exhausting pipe 72. A control unit 12 is provided in front of the blower chamber section 6 located on a base 10 to control the operation of the combustion apparatus 1. A blower 14 is provided in the blower chamber section 6 at the back of the control unit 12 and connected to the air supply path 74. The blower 14 is controlled by the control unit 12 to supply air to the combustion chamber section 4 via the air supply path 74.

The combustion chamber section 2 has a lower bottom portion 22 formed on the base 10. The bottom portion 22 is made of concrete in this embodiment. However, other material may be used. The upper surface of the bottom portion 22 has a dent structure at the center portion in a semi-spherical manner. Thereby, pieces or liquefied drops of an object to be burned drop from a upper portion upon combustion and are collected in the dent portion where they are completely combusted. A temperature detecting unit 16 is provided in the vicinity of the bottom portion 22, at a position slightly apart from the center of the bottom portion 22 in the embodiment. The temperature detecting unit 16 is connected to the control unit 12 and detects a combustion temperature to inform the detected combustion temperature to the control unit 12. An igniting unit 17 is also provided in vicinity of the bottom portion 22, at a position slightly apart upwardly from the upper surface of the bottom portion 22. The igniting unit 17 is also controlled by the control unit 12.

An inner combustion drum member 24 defining a combustion chamber 30 is provided to be coupled to and extending upwardly from the bottom portion 22. The top portion of the drum member 24 is closed by a top plate 25 to form the closed combustion chamber 30. The cross section of the drum member 24 is circular in the embodiment. However, it is not limited to the circular member. The drum member 24 is provided with a temperature detecting unit 18 at the upper portion. A temperature detected by the unit 18 is outputted to the control unit 12 and used to control the amount of air supplied. An outer drum member 32 is also coupled to and extending upwardly from the bottom portion 22 at the outside of the drum member 24. Thus, a gap space 42 is formed between the inner drum member 24 and the outer drum member 32 and it is closed by the bottom portion 22 at the bottom. The outer drum member 34 is narrowed at a portion above the top plate 25 and the outer drum member 34 is connected to a water vapor exhausting chimney 36 at the top. A water supply inlet 21 is provided at the upper portion of the outer drum member 32 and cooling water is supplied in the gap space 42 from the Water supply inlet 21 which is connected to a water supplier (not shown) via a valve 20. A water level sensor 19 is provided within the gap space 42 a the upper inside portion of the outer drum member 32 to sense the level of cooling water therein. The sensed result is informed to the control unit 12. The valve is controlled to be closed or opened by the control unit 12 in accordance with the sensed result. The water vapor produced from the cooling water being heated up during combustion is exhausted from the water vapor exhausting chimney 36.

Figure 3:
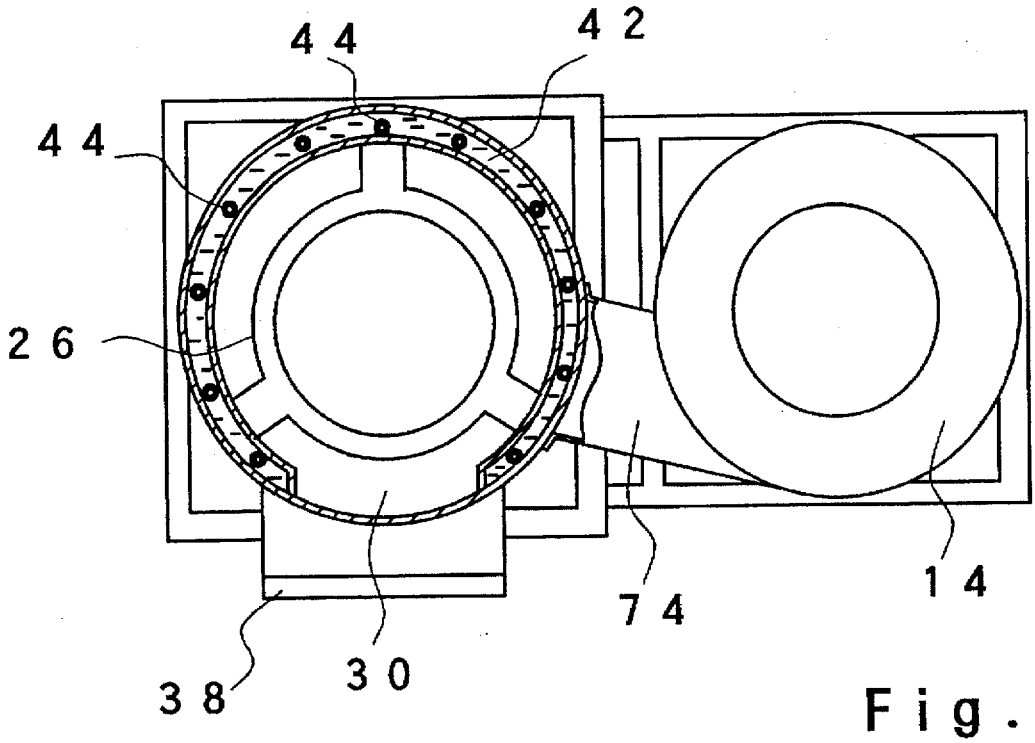
FIG. 3 is a schematic top plan view diagram showing the combustion apparatus according to the embodiment of the present invention with a partial cross sectional view.

As shown in FIG. 3, a plurality of thin air supply pipes 44 are provided in the gap space 42 to be connected to the air supply path 74 and to extend upwardly along the outer surface of the inner drum member 24. Each of the plurality of air supply pipes 44 is formed at the portion contacting the inner drum member 24 with a large number of openings which penetrate the inner drum member 24. The plurality of thin air supply pipes 44 jet or blow out the air supplied from the blower 14 through the air supply path 74 toward the center portion of the combustion chamber 30.

Figure 5A:
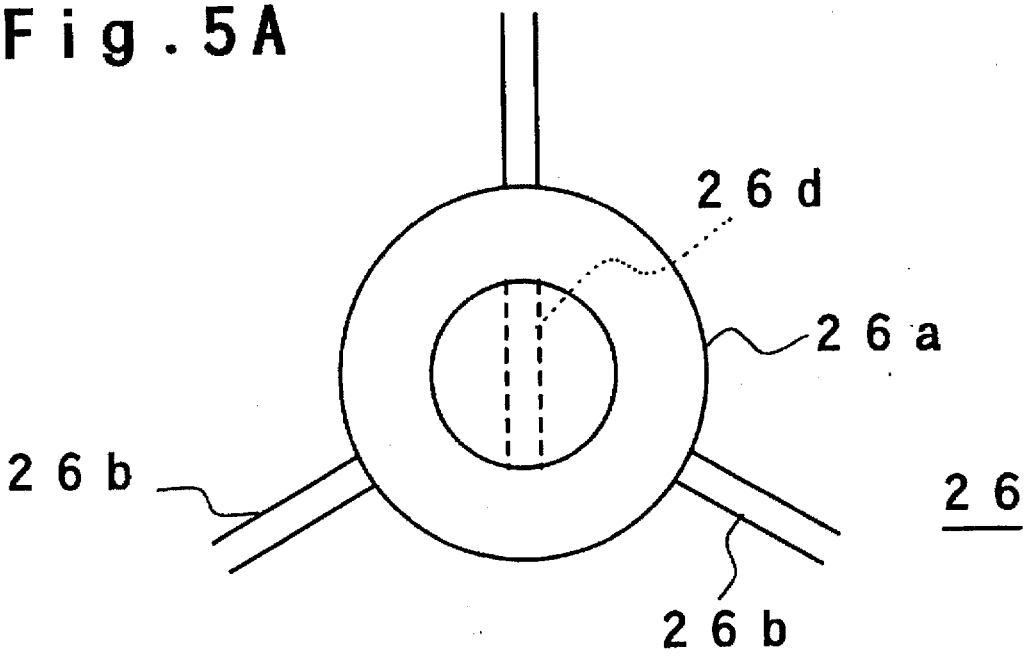
FIGS. 5A and 5B are schematic diagrams showing top plan view and bottom plan view diagrams of an air blowing section of the combustion apparatus according to the embodiment of the present invention, respectively.
Figure 5B:
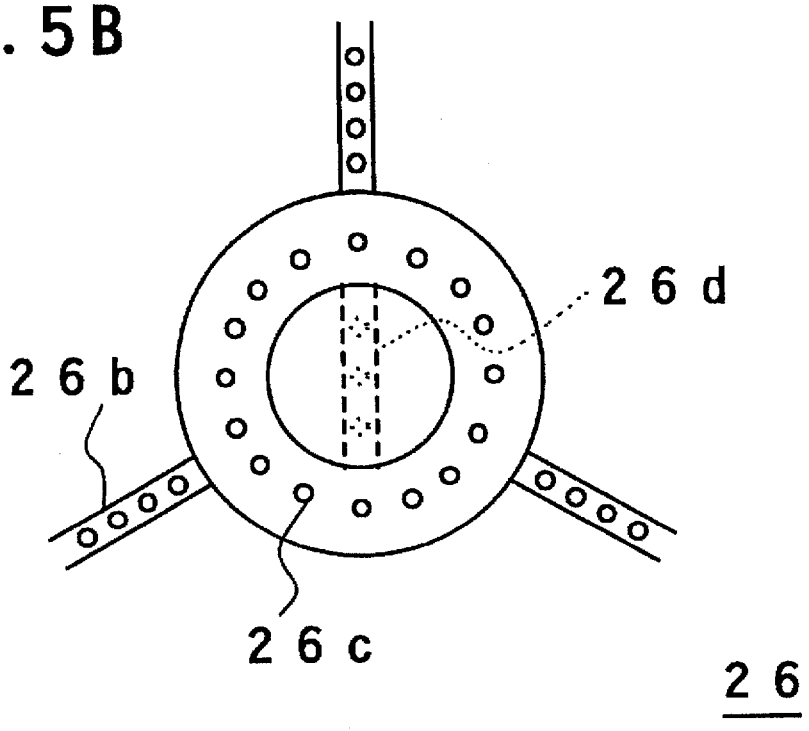

Referring to FIG. 2 again, an air blowing section 26 is formed at the lower portion of the combustion chamber 30. The air blowing section 26 has the structure shown in FIG. 5A and 5B. FIGS. 5A and 5B show the air blowing section 26 when viewed from the upper portion of the combustion chamber 30 and from the bottom portion 12, respectively. As seen from these figures, the air blowing section 26 composed of a circular pipe 26*a* and three bridge pipes 26*b* connected to the circular pipe 26*a* and extending slantly downwardly. The circular pipe 26*a* is connected to the air supply path 74 via the pipes 26*b*. It is not always necessary for the pipe 26*a* to be circular. The pipe 26*a* may be a closed loop or an open loop. In addition, the number of pipes 26*b* is 3 in the embodiment. However, the present invention is not limited to 3 and more or less pipes may be permitted if the circular pipe 26*a* can be mechanically effectively supported and air can be sufficiently supplied. The diameter of the circular pipe 26*a* is as large as about a half of diameter of the inner drum member 24. There is no opening at the upper portion of the circular pipe 26*a* as seen from FIG. 5A while there are a large number of openings 26*c* at the lower portion thereof as shown in FIG. 5B. This is the reason why formation of the openings on the lower surface prevents drops formed when object to be burned is liquefied during combustion, from filling the openings 26*c*. However, more substantial reason will be described later. It would be apparent to a person skilled in the art that the air blowing section 26 may have another shape. For instance, a pipe 26*d* crossing the circular pipe 26*a* may be added to the center portion of the circular pipe 26*a* as shown in FIG. 5A by a dashed line. Baking finish of Alminium is performed on the surfaces of the circular pipe 26*a* and the bridge pipes 26*b*. When these pipes are made of iron, oxidation occurs because of heat during the combustion so that the pipes are given remarkable damage. For this reason, in order to prevent the oxidization, the baking finish of Alminium is performed. However, a ceramic film may be coated on these surfaces in place of baking finish of Alminium. Further, the baking finish of Alminium or coating of ceramic film may be performed for not only on the surfaces of the circular pipe 26*a* but also the inner wall of the combustion chamber 30.

An entrance 38 is provided at the center portion of the combustion chamber 30 to penetrate the inner and outer drum members 24 and 32 for throwing an object to be burned into the combustion chamber 30. The gas exhausting pipe 72 is provided at a upper portion of the combustion chamber 30 to extend from the inside of the combustion chamber 30 to the inside of the dust collector section 4 through the inner and outer drum members 24 and 32 and the wall of the dust collector section 4. The dust collector section 4 is provided on the blower chamber section 6 and isolated from it. The lower portion 52 of a chimney 54 is deeply inserted in the dust collector section 6. Thus, heavy dust particles of the gas exhausted through the exhausting pipe 72 sediment in the dust collector section 6, so that only the heated air is exhausted through the chimney 54.

Figure 4:
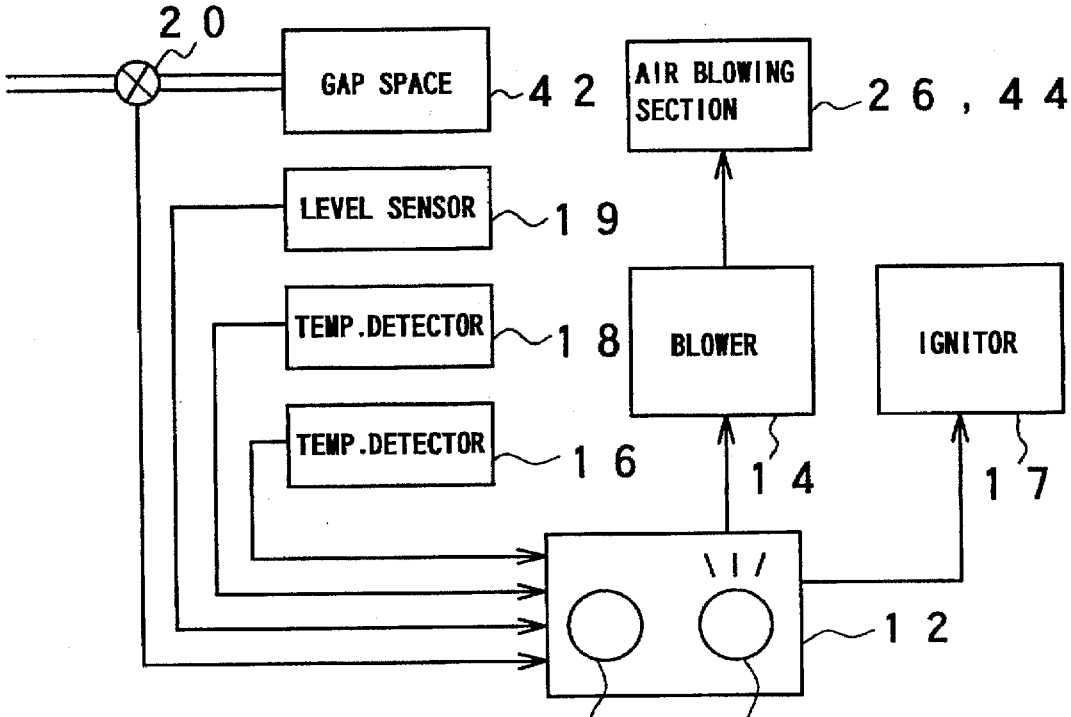
FIG. 4 is a block diagram showing a control system of the combustion apparatus according to the embodiment of the present invention.

Next, the control of the combustion apparatus 1 will be described below with reference to FIG. 4. The control unit 12 is provided with an air supply control switch 12*a* and an igniting unit control switch 12*b* on the front panel. The user first sets the air supply control switch 12*a* based on an object to be burned to select an initial amount of air suitable for the object to be burned. Also, the user operates the igniting unit control switch 12*b* to start burning. The water level in the gap space 42 is detected by the water level sensor 19 which is provided in a upper portion of the gap space 42 at an appropriate position and is informed to the control unit 12. When the water level has dropped, the control unit 12 control the valve 20 to be opened in accordance with the sensing result by the sensor 19 to supply cooling water into the gap space 42 via the inlet 21. Thus, even if the cooling water is decreased during the combustion, the combustion chamber 30 is not overheated, resulting in the long life of the combustion apparatus 1. The temperatures detected by the detecting unit 16 which is provided in the vicinity of the bottom portion 12 and the detecting unit 18 which is provided in the upper portion of the combustion chamber 30 are both informed to the control unit 12. The control unit 12 controls the blower 14 in accordance with the detected temperatures such that the amount of air supplied from the blower to the air blowing section 26 via the air supply path 74 is adjusted to an optimal value. It should be noted that the number of temperature detecting units is not limited to 2. More temperature detecting units may be provided.

Next, the operation of the combustion apparatus 1 will be described below with reference to FIG. 6. In a case that an object to be burned is combustible as wasted plastics, flammable object such as paper is first thrown into the combustion chamber 30 via the waste entrance 38 and then the object to be burned is thrown. Thereafter, the paper is ignited by the igniting unit 17 through the operation of the ignition unit control switch 12*b*. In a case of waste such as tire and sludge which is difficult to be burned, after paper is first thrown, combustion assisting material such as plastics having high calorific value is thrown, and then the ignition is performed through the operation of the igniting unit control switch 12*b*. When the assisting material starts to burn, the blower is turned on manually through the operation of the air supply control switch 12*a* or automatically. Thereafter, the tire or sludge is thrown into the combustion chamber 30 via the waste entrance 38. After a predetermined period of time, the control unit 12 receives the detected temperatures from the detecting units 16 and 18 to automatically control the blower 14 to supply air to the combustion chamber 30 such that the combustion is performed in a state suitable for the object or waste to be burned. That is, the control unit 12 monitors the outputs of the temperature detecting units 16 and 18 and controls the blower 14 to increase the amount of air to be supplied when actual combustion temperatures are lower than those expected from the amount of air set based on the waste to be burned. On the other hand, when actual combustion temperatures are higher than those expected from the amount of air set based on the waste to be burned, the control unit 12 controls the blower 14 to decrease the air supply. Thereby, the waste can be subjected to complete combustion at the optimal temperature. At the same time, because there is no case that the combustion temperature is increased unnecessarily, the damage of the combustion chamber 30 can be eliminated, and the generation of smoke and harmful gas can be suppressed. Further, the control unit 12 monitors the output of the water level sensor 19 during the combustion. When receiving the sensing result indicative of lowering of the water level, the control unit 12 controls the valve 20 to be opened such that cooling water is supplied upto a predetermined level. Then the control unit 12 controls to valve 20 to be closed. In this manner, the combustion is performed.

Figure 6:
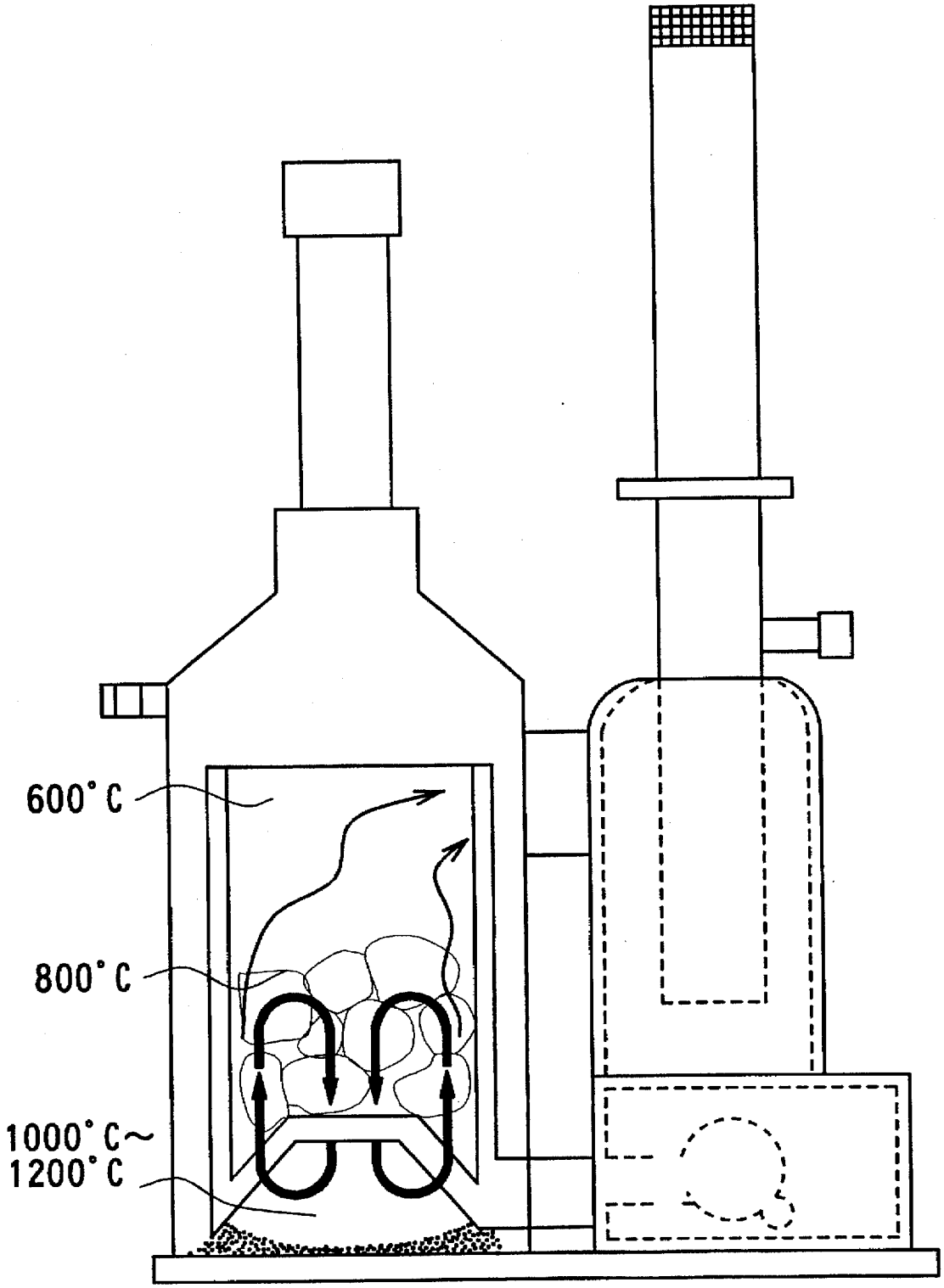
FIG. 6 is a schematic diagram showing a combustion state and a temperature distribution in the combustion apparatus according to the embodiment of the present invention.

The combustion state in the combustion chamber 30 is shown in FIG. 6. The waste to be burned such as plastics located above the air blowing section 26 is liquefied due to the combustion heat to drop to the bottom portion 22, so that the drops flow into the central dent portion of the bottom portion 22 to bank therein. Pieces of the waste to be burned such as tire also drop to the bottom portion 22. In this case, because there is no opening at the upper side of the circular pipe **26*a* and communicating pipes 26*b* of the air blowing section 26**, there is no possibility that any openings are filled with the drops or dropped pieces.

At this time, because a large amount of air is blown out from the blowing section 26 toward the bottom portion 22, air flow from a portion above the air blowing section 26 toward the bottom portion occurs at the center portion of the bottom portion 22. In this manner, there is sufficient air at the center portion of the bottom portion 22. Therefore, complete combustion is performed for the object or waste to be burned and the combustion temperature in the vicinity of the bottom portion 22 is in the range from about 1000 to about 1200 ° C. The combustion gas generated at the bottom portion 22 as well as the heated air rises upwardly along the inner wall of the combustion chamber 30 in the outside of a circle of the circular pipe **26*a* because of the air flow toward the bottom portion 22. In this time, the rising air flow is cooled by the cooling water in the gap space 42. Most of the rising gas flow is exhausted to the dust collector section 4 via the gas exhausting pipe 72, while the remaining part of the rising gas flow is directed toward the bottom portion 22 through the inside of the circle formed by the circular pipe 26*a* together with the supplied and blown out air from the circular pipe 26*a* again because the air continues to be blown out from the air blowing section 26. In this manner, convection of air (combustion gas) occurs around the circular pipe 26*a*. In a conventional combustion apparatus, air (combustion gas) rises upwardly at the center portion of the combustion chamber. Thus, in the conventional combustion apparatus, there is no convection or, even if it occurs, the direction and position of the convection is quite different from those of the present invention. In the above meaning, the blower 14, the air supply path 74 and the air blowing section 26** act as convection generating means.

In a conventional combustion apparatus, as described above, the combustion temperature is about 600° C. at the lower portion of the combustion chamber, about 800° C. at the middle portion thereof, and about 1000° C. at the upper portion thereof. On the contrary, in the present invention, the combustion temperature is about 1000° C. to 1200° C. at the lower portion of the combustion chamber 30, about 800° C. at the middle portion thereof, and about 600° C. at the upper portion thereof. In this manner the temperature distribution is inverted in the present invention, compared to that in the conventional combustion apparatus. In this meaning, the blower 14, the air supply path 74 and the air blowing section 26 act as combustion temperature inverting means or combustion temperature control means. This is because sufficient air is supplied from the air blowing section 26, so that the complete combustion region is confined in the vicinity of the bottom portion 22. This is quite different from the conventional combustion apparatus. In this meaning, the blower 14, the air supply path 74, and the air blowing section 26 act as confining means for confining the maximum temperature region upon the combustion in the vicinity of the bottom portion 22.

Next, the test result is shown in the following table 1 when synthetic rubber and crude rubber of 30 Kg in total were combusted using the combustion apparatus 1 according to the present invention. In this case, combustion assisting material was not used. The exhausted gas was measured at the detecting port 58 provided in the gas exhausting chimney 54. The test result is as follows.

TABLE 1

| | |
|---|---|
| nitrogen oxide | 180 V/Vppm |
| sulfur oxide | 0.36 $m^3N/h$ |
| hydrogen chloride | 120 $mg/m^3N$ |
| dust | 0.049 $g/m^3N$ |

As seen from the above table 1, the exhausted gas detected by a measuring device satisfies regulated values to a great extent. Specifically, the amounts of nitrogen oxide and sulfur oxide exhausted gases are very less. The nitrogen oxide is generated during the combustion and as the combustion temperature increases the amount of nitrogen oxide increases more and more. However, in order to perform the complete combustion of waste, it is desirable that the combustion is performed at a temperature as high as possible. Thus, the suppression of generation of nitrogen oxide and the complete combustion are antinomy in the conventional combustion apparatus. However, in the present invention, the waste is completely combusted in the high temperature region confined in the vicinity of the bottom portion 22. It is deemed that nitrogen oxide generated in the high temperature region is adhered to or absorbed to the waste being burning while it rises upwardly from the bottom portion 22, so that the amount of it to be exhausted is decreased, since the temperature is lower at the upper portion of the combustion chamber 30. In addition, since the complete combustion is performed in the high temperature region, residue is very less and dust in the exhausted gas is also very less.

Next, a modification of the combustion apparatus according to the present invention will be described below with reference FIGS. 7A to 7C. The air blowing holes **26*c* provided in the air blowing section 26 are formed to be orthogonal to the pipe as shown in FIGS. 5A and 5B. However, in order to make it easy for convection to occur, the air blowing holes 26*c* may be formed to be oblique to the pipe as shown in FIG. 7A. By this structure, air is blown obliquely and downwardly, so that vortex or eddy is generated toward the bottom portion 22 such that convection is made easy to occur. In addition, an inner pipe 26*e* may be provided in the inside of each of the pipes 26*a* and 26*b* to form a double pipe structure such that the cooling water may be flowed into the inner pipe 26*e*. Thus, the external pipes 26*a* and 26*b*** is cooled so that the damage or degradation of them can be eliminated.

Further, the air blowing section 26 may be formed, in place of the pipes **26*a* and 26*b*, by a plurality of projection portions 82 which are provided at the lower portion of the drum member 24 of the combustion chamber 30, as shown in FIGS. 7B and 7C. The distance or height of the projection portions 82 from the bottom portion 22 is chosen such that air convection is easy to be generated. In this example, the height is approximately equal to the radius of the combustion chamber 30 from the bottom portion 22. In an example shown in FIGS. 7B and 7C four projection portions are provided. The projection portions 82 are connected to the air supply path 74. The tip portion of each projection protrudes in a direction directing the center of the combustion chamber 30 by about a half of the radius of the drum member 24 of the combustion chamber 30. Each protection portion 82 is provided with a large number of air blowing holes 82***c* on the surface facing to the bottom portion 22 and blows air toward the bottom portion 22. As a result, the same advantage as in the above mentioned embodiment can be attained. The inner upper portion of the protection portion 82 is connected to the gap space 42 and cooled by the cooling water.

Figure 8A:
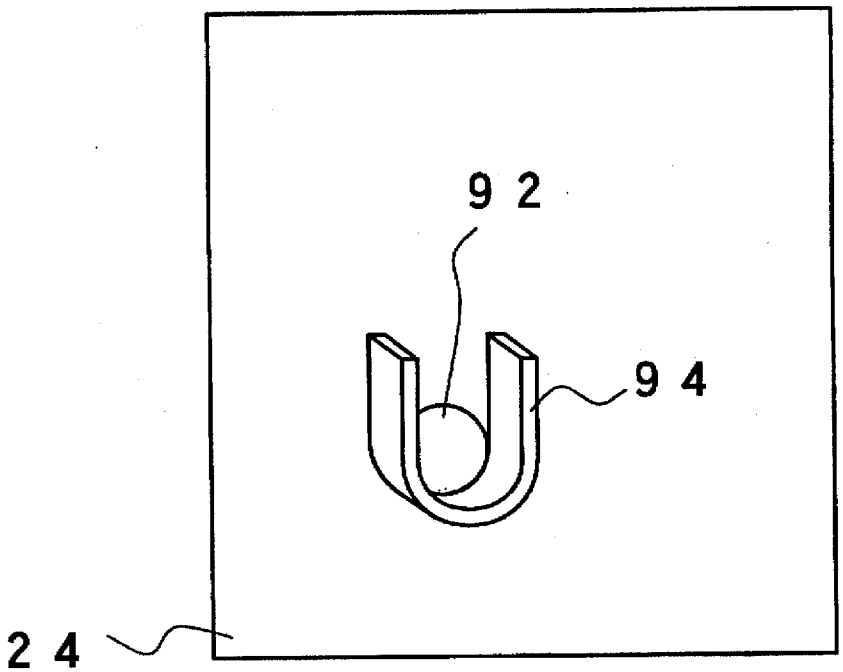
FIGS. 8A and 8B are schematic diagrams showing a reception section on a combustion chamber wall and the air blowing section in another modification of the air blowing section, respectively.
Figure 8B:
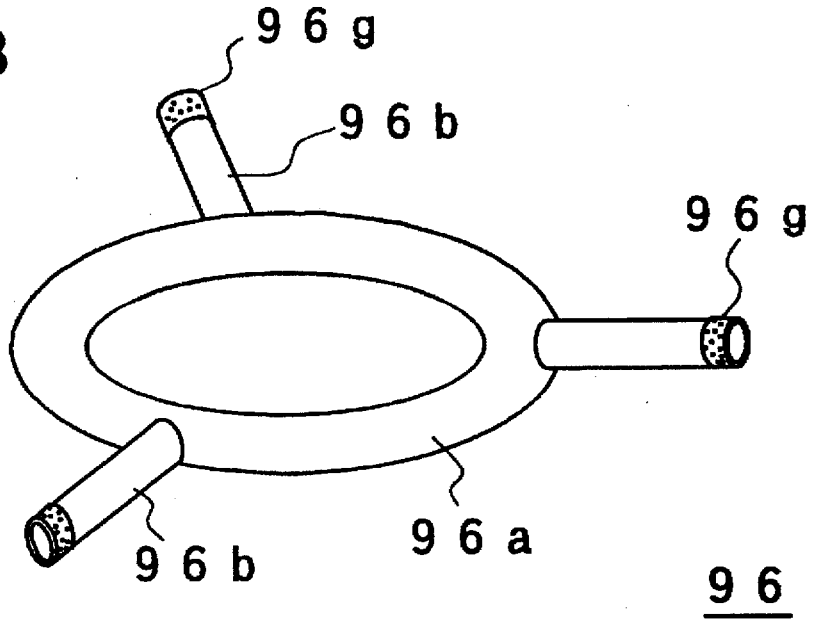

Next, another modification of the air blowing section 26 will be described below with reference to FIGS. 8A and 8B. In the modification, the air blowing section 26 is composed of a circular pipe 96*a* and three bridge pipes 96*b*. A large number of holes (not shown) are formed on the surface of each of the circular pipe 96*a* and bridge pipes 96 facing to the bottom portion 22, as in the pipes 26*a* and 26*b*. The bridge pipes 96*b* are connected to the air supply path 74 and the pipe 96*a*. Therefore, air is passed to the circular pipe 96*a* from the air supply path 74. Heat resistant material 96*g* is wound around the tip portion of each of the bridge pipes 96*b*. Three openings are provided on the inner wall of the drum member 24 of the combustion chamber 30 at a predetermined height from the bottom portion 22 and are connected to the air supply path 74. The height from the bottom portion 22 is chosen such that air convection is easy to be generated. In this example, the height is approximately equal to the radius of the combustion chamber 30 from the bottom portion 22. A reception member 94 is formed in each of the three openings 92 such that it surrounds the opening 92 a half or more and has the structure to receive the bridge pipe 96*b*. Thus, the tip portions of the bridge pipes 96*b* are received by the corresponding reception members 94 and the air supplied from the blower 14 is blown out from the holes 92. Although the connection between the opening 92 and the bridge pipe 96*b* is a problem, the strictness of connection is not required because the air blowing holes are provided in the pipes 96*a* and 96*b*. Therefore, by winding heat resistant material 96*g* around the tip portion of each of the bridge pipes 96*b*, the problem on the connection could be solved. Also, the heat resistant material 96*g* can prevent the bridge pipe 96*b* from being adhered to the reception member 94 in use for a long time. In this manner, the modification of the air blowing section 26 is detachable and therefore can be replaced by a new one, if necessary.

It is desirable that the circle of the circular pipe 26*a* or 96*a* of the air blowing section has the diameter as great as the radius of the drum member 24 of the combustion chamber 30. If the diameter of circle of the circular pipe is too small, the air flow toward the bottom portion 22 is localized and it is not desirable. On the contrary, if the circle has too great, an air flow would occur at the central portion of the combustion chamber 30 to rise upwardly. Therefore, when the combustion chamber 30 has a great diameter, a plurality of circular pipes such as the pipe 96*a* or 26*a* may be provided concentrically. As a result, the convection could be generated effectively.

Figure 9A:
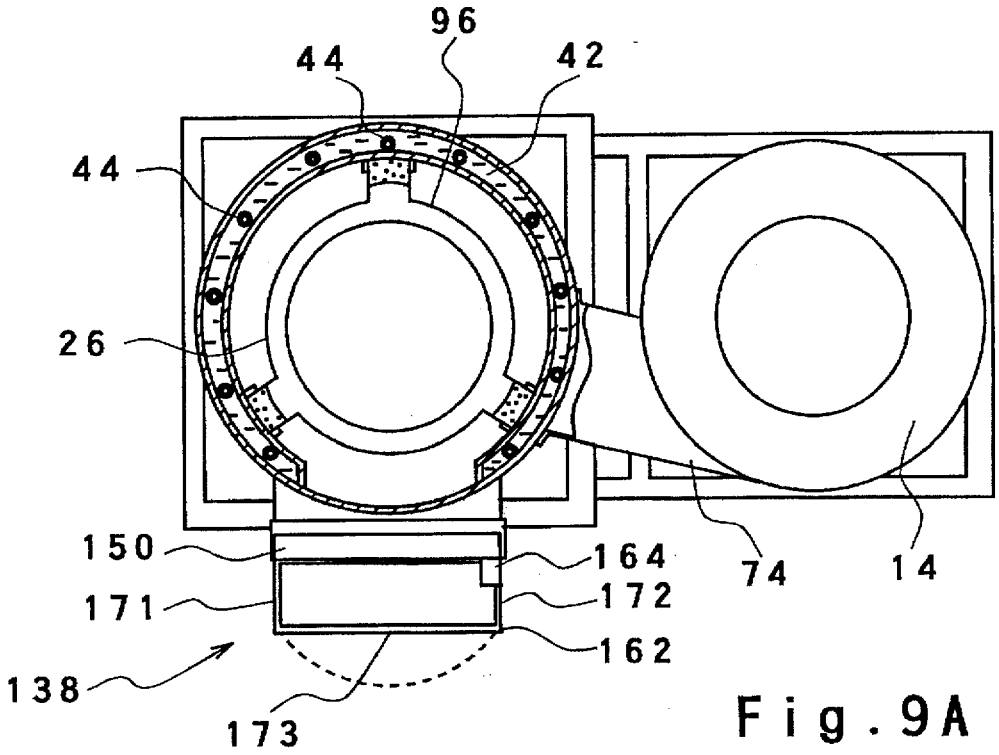
FIGS. 9A, 9B and 9C are a schematic top plan view diagram showing the combustion apparatus according to another embodiment of the present invention with a partial cross sectional view, a schematic side plan view diagram showing the combustion apparatus according to the other embodiment, and a schematic front view diagram showing the combustion apparatus according to the other embodiment, respectively.
Figure 9B:
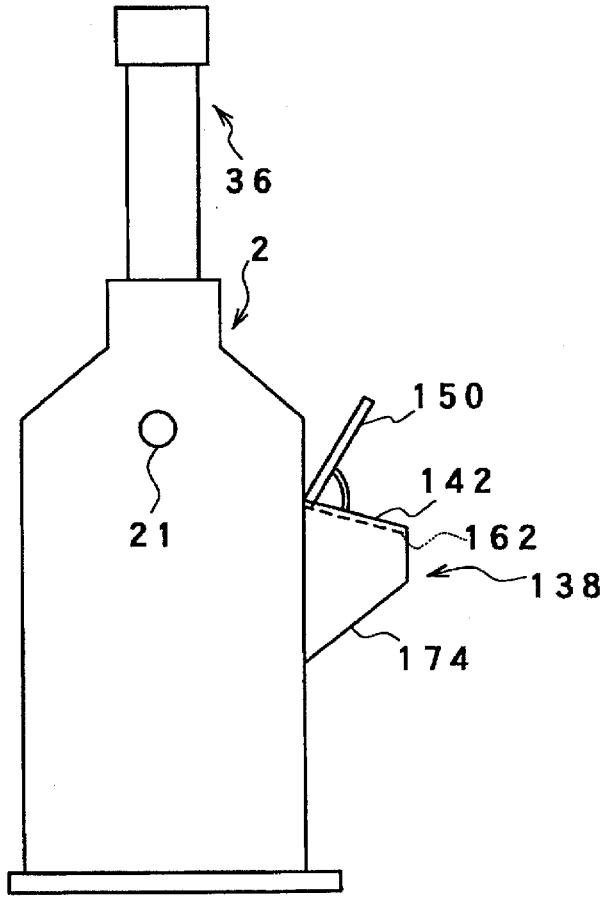
Figure 9C:
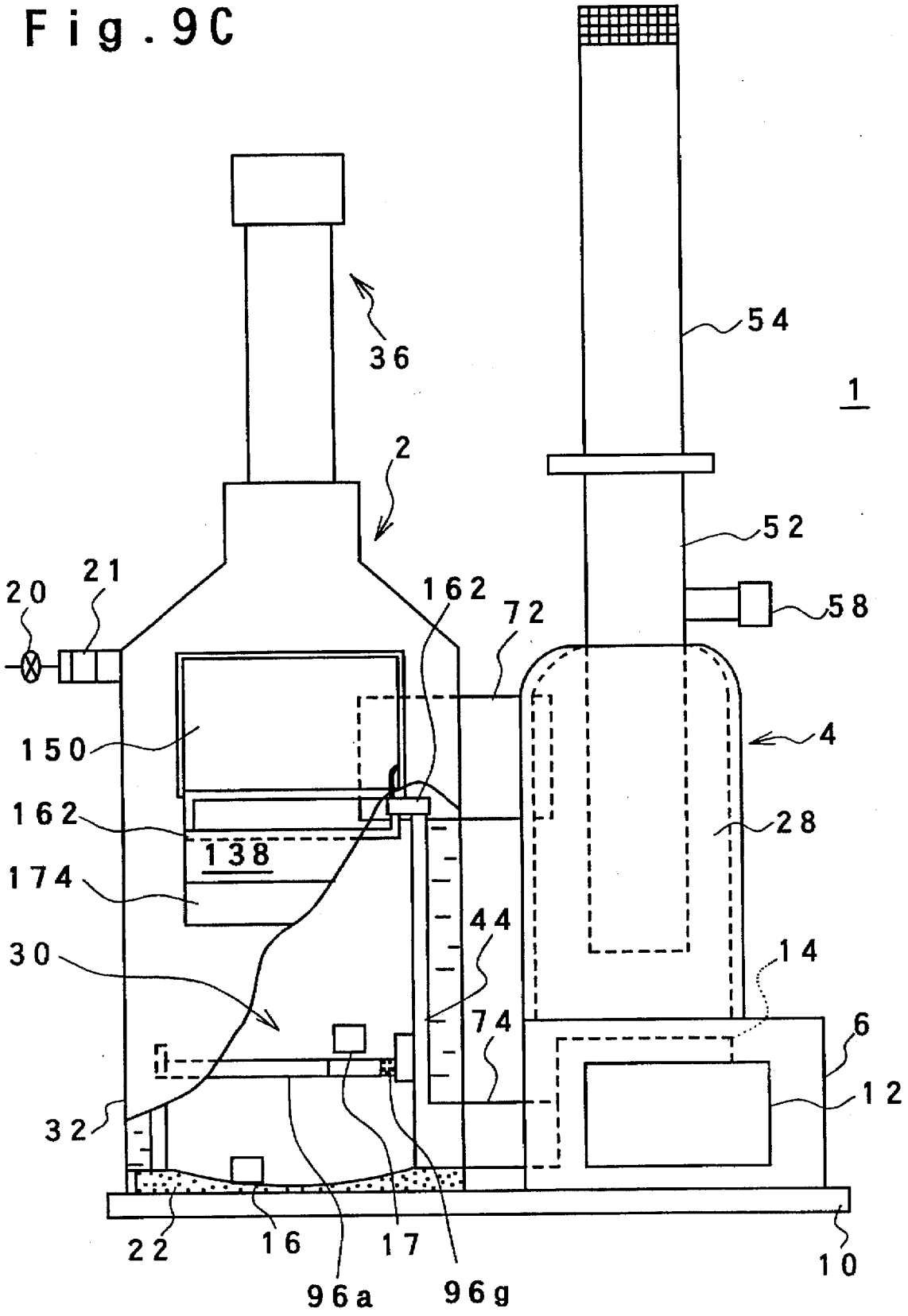

Next, a combustion apparatus according to another embodiment of the present invention will be described below with reference to FIGS. 9A to 9C. In this embodiment, only a waste entrance is different from the above embodiment and the other portions are the same as those in the above embodiment.

The waste entrance 138 is formed to protrude from the combustion chamber 30. The waste entrance 138 has a closure 150 and an air supply control mechanism 164. The waste entrance 138 has side walls 171 and 172, a front wall 173, and a tapered lower wall 174 provided between the front wall 173 and the outer drum member 32 and connected to the side walls 171 and 172. The waste entrance 138 has an opening in the top portion. The opening may be provided on a horizontal plane or provided on a slantly inclined plane as shown in FIG. 9B. The opening is rectangular as shown in FIG. 9A. However, the opening may be in a round form as shown in FIG. 9A by a dashed line. An air supply pipe 162 is provided around the opening in this embodiment. However, it is not limited to this. The pipe 162 may be provided in partial. The air supply pipe 162 has a plurality of holes and connected to the air supply path 74 via and air supply pipe 44 and the air supply control mechanism 164, as shown in FIG. 9C. The air supply control mechanism 164 operates to connect the air supply pipe 162 with the air supply path 74 when the closure 150 is opened and to disconnect the air supply pipe 162 from the air supply path 74 when the closure 150 is closed. Thus, when the closure 150 is opened, air is supplied from the blower 14 through the air supply path 74 and blown into the combustion chamber 30 from the plurality of holes of the air supply pipe 162. The air blowing prevents flame from being blown out from the waste entrance 138, as if an air curtain is provided. In this manner, the user can easily throw waste to be burned into the combustion chamber 30. In addition, because the waste entrance 138 has the tapered lower portion 174, the waste thrown from the entrance 138 slides into the combustion chamber 30 over the tapered lower portion 174. Therefore, the user can easily throw the waste.

Figure 10:
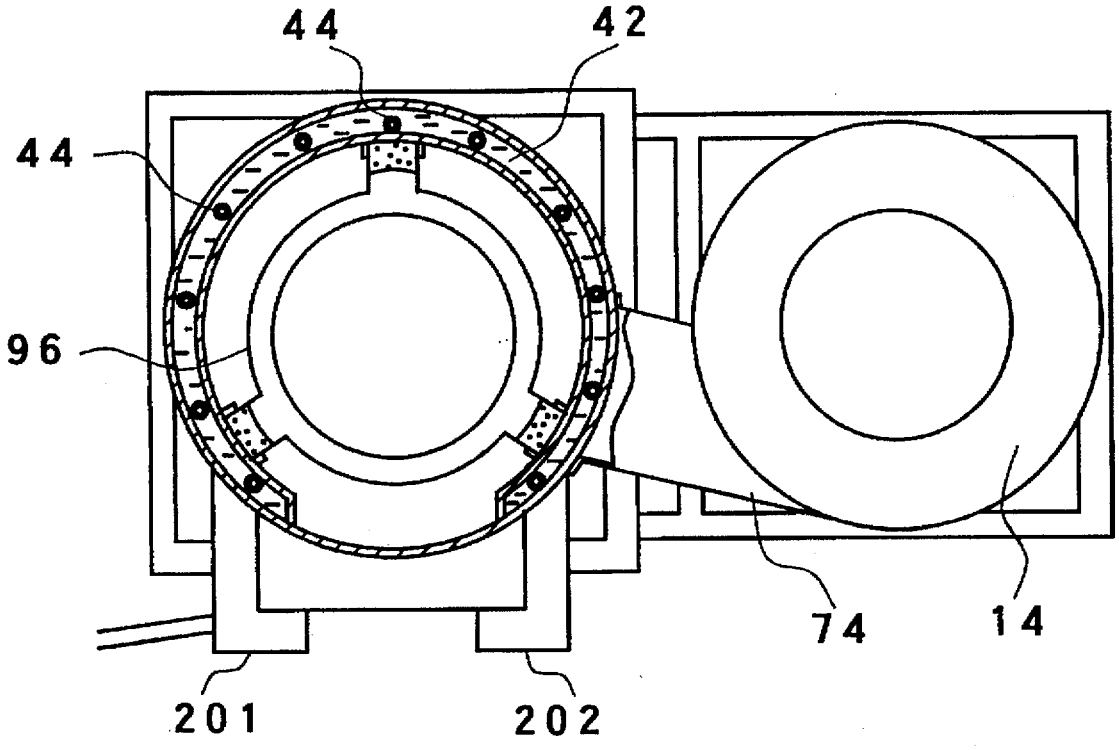
FIG. 10 is a schematic diagram showing the combustion apparatus according to a still another embodiment of the present invention.

Next, a combustion apparatus according to further another embodiment of the present invention will be described below with reference to FIG. 10. In this embodiment, a burner 201 and a collector 202 are further provided at the bottom portion 22 in addition to the combustion apparatus shown in FIG. 2. Also, the upper surface of the bottom portion 22 is flat although it is a dent surface in the above embodiment. When the combustion of waste is continuously performed so that ash and residue are piled on the bottom portion 22 surface, the burner 22 is ignited and blows out flame with a pressure. The ash and residue are blown off with the pressure. The blowing pressure is extracted from the collector 202. At the same time, the blown ash and residue are collected by the collector 202. Thus, the continuous operation of the combustion apparatus is made possible because the ash and residue can be removed. In this case, the reason that the burner 201 not an air supply device is used is as follows. If the air supply device is used, the convection would be distorted and the combustion temperature would be decreased. As a result of these, there is possibly a case that the complete combustion cannot be performed. Therefore, a hot gas is supplied by the burner 201 to prevent the convection from being distorted.

What is claimed is:

1. A combustion apparatus comprising:

a combustion chamber having a bottom portion;

a blower for supplying combustion air;

air blowing means provided at a lower portion of said combustion chamber, for blowing out the combustion air supplied from said blower toward said bottom portion such that a maximum combustion temperature portion is located in the vicinity of said bottom portion of the blown combustion air;

a conduit extending from the blower to the lower portion of a combustion chamber, said conduit including at least two openings facing downward to allow combustion air to flow into the bottom portion of the combustion chamber, the openings being located radially outward from a center of the combustion chamber such that the combustion air flows radially inward towards a combustible object therein;

burner means provided at said bottom portion, for flowing out flame; and collecting means provided at said bottom portion, for collecting ash piled at said bottom portion and blown off by said burner means.

2. A combustion apparatus according to claim 1, wherein said air blowing means comprises:

air path means for passing the air from said blower; and a circular pipe having at least one opening on its lower surface, provided above a central portion of said bottom portion, and connected to said air path means, for blowing out the air supplied from said blower through said air path means, from said opening toward said bottom portion.

3. A combustion apparatus according to claim 1, wherein said air blowing means comprises:

air path means for passing the air from said blower; and a plurality of protection portions having at least one opening on its lower surface, provided on an inner wall of said combustion chamber at a lower portion of said combustion chamber, and connected to said air path means, for blowing out the air supplied from said blower through said air path means, from said opening toward said bottom portion.

4. A combustion apparatus according to claim 1, wherein said air blowing means comprises:

air path means for passing the air from said blower to at least one first opening provided on a wall of said combustion chamber; and a detachable circular pipe with at least one bridge pipe corresponding to said at least one first opening, said bridge pipe being connected to said first opening, wherein said circular pipe has at least one second opening on its lower surface, and is provided above a central portion of said bottom portion to blow out the air supplied from said blower through said air path means, from said second opening toward said bottom portion.

5. A combustion apparatus according to claim 1, further composing:

at least one temperature detector means for detecting a temperature; and control means for controlling said blower to change an amount of air supply in accordance with the detected temperature.

6. A combustion apparatus according to claim 1, further comprising an entrance provided to protrude from said combustion chamber and to have a tapered lower portion and having a closure, for throwing an object to be burned into said combustion chamber.

7. A combustion apparatus according to claim 6, wherein said entrance further includes air curtain means provided in at least a portion of said entrance, connected to said blower, and responsive to an operation of said closure, for preventing flame from being blown out from said entrance by the air supplied from said blower when said closure is opened.

8. An incinerator apparatus comprising:

a combustion chamber having a bottom portion;

convection means for forcedly making convection to occur in the vicinity of said bottom portion of blowing a combustion air toward a center of said bottom portion, such that said combustion air is moved toward said bottom portion in the center portion of the bottom portion and combustion gas rises upwardly along a wall of said combustion chamber;

a conduit extending from the blower to the lower portion of a combustion chamber, said conduit including at least two openings facing downward to allow combustion air to flow into the bottom portion of the combustion chamber, the openings being located radially outward from a center of the combustion chamber such that the combustion air flows radially inward towards a combustible object therein;

said convection means comprises:

a blower for supplying air;

air blowing means provided at a lower portion of said combustion chamber, for blowing out the air supplied from said blower toward said bottom portion;

at least one temperature detector means for detecting a temperature; and control means for controlling said blower to change an amount of air supply in accordance with the detected temperature.

9. An incinerator according to claim 8, wherein said air blowing means comprises:

air path means for passing the air from said blower to at least first opening provided on a wall of said combustion chamber; and a detachable circular pipe with at least one bridge pipe corresponding to said at least one first opening, said bridge pipe being connected to said first opening, wherein said circular pipe has at least one second opening on its lower surface, and is provided above a central portion of said bottom portion to blow out the air supplied from said blower through said air path means, from said second opening toward said bottom portion.

10. An incinerator according to claim 8, wherein said air blowing means is treated to prevent oxidization.

11. An incinerator comprising:

a combustion chamber having a top portion ann a bottom portion;

temperature inverting means for burning waste in a temperature distribution in which a temperature in the vicinity of said bottom portion is higher than that in the vicinity of said top portion by blowing a combustion air said combustion chamber; and a conduit extending from the blower to the lower portion of a combustion chamber, said conduit including at least two openings facing downward to allow combustion air to flow into the bottom portion of the combustion chamber, the openings being located radially outward from a center of the combustion chamber such that the combustion air flows radially inward towards a combustible object therein.

12. A combustion apparatus comprising:

a combustion chamber having a bottom portion;

a blower for air supplying air;

air blowing means air blowing means for blowing the air supplied from said blower toward said bottom portion in said combustion chamber such that convection is caused around said air blowing means;

detecting means provided in said combustion chamber, for detecting a temperature;

control means for controlling said blower in accordance with the detected temperature such that said blower increases or decreases an amount of air to be supplied;

a conduit extending from the blower to the lower portion of a combustion chamber, said conduit including at least two openings facing downward to allow combustion air to flow into the bottom portion of the combustion chamber, the openings being located radially outward from a center of the combustion chamber such that the combustion air flows radially inward towards a combustible object therein;

an entrance provided to protrude from said combustion chamber and to have a tapered lower portion and having a closure, for throwing an object to be burned into said combustion chamber;

said entrance further includes air curtain means provided in at least a portion of said entrance, connected to said blower, and responsive to an operation of said closure, for preventing flame from being blown out from said entrance by the air supplied from said blower when said closure is opened.

13. A combustion apparatus according to claim 12, wherein said air blowing means comprises:

air path means for passing the air from said blower; and a plurality of projection portions having at least one opening on its lower surface, provided on an inner wall of said combustion chamber at a lower portion of said combustion chamber, and connected to said air path means, for blowing out the air supplied from said blower through said air path means, from said opening toward said bottom portion.

14. A combustion apparatus according to claim 12, wherein said air blowing means comprises:

air path means for passing the air from said blower to at least one first opening provided on a wall of said combustion chamber; and a detachable circular pipe with at least one bridge pipe corresponding to said at least one first opening, said bridge pipe being connected to said first opening, wherein said circular pipe has at least one second opening on its lower surface, and is provided above a central portion of said bottom portion to blow out the air supplied from said blower through said air path means, from said second opening toward said bottom portion.

15. A combustion apparatus according to claim 12, further comprising:

burner means provided at said bottom portion, for flowing out flame; and collecting means provided at said bottom portion, for collecting ash piled at said bottom portion and blown off by said burner means.

16. A combustion apparatus according to claim 12, wherein said air blowing means is treated to resist a combustion temperature.

17. A combustion apparatus comprising:

a combustion chamber;

a blower for supplying air;

an entrance provided to protrude from said combustion chamber and to have a tapered lower portion, and having a closure, for throwing an object to be burned into said combustion chamber;

air curtain means provided in at least a portion of said entrance, connected to said blower, and responsive to an operation of said closure, for preventing flame from being blown out from said entrance by the air supplied from said blower when said closure is opened; and a conduit extending from the blower to the lower portion of a combustion chamber, said conduit including at least two openings facing downward to allow combustion air to flow into the bottom portion of the combustion chamber, the openings being located radially outward from a center of the combustion chamber such that the combustion air flows radially inward towards a combustible object therein.

18. A combustion apparatus comprising:

a combustion chamber having a bottom portion;

a blower for supplying air; and air blowing means provided at a lower portion in said combustion chamber, for blowing out the air supplied from said blower toward said bottom portion such that a maximum combustion temperature portion is located in the vicinity of said bottom portion by the blown air, and wherein said air blowing means comprises:

air path means for passing the air from said blower; and a circular pipe having at least one opening on its lower surface, provided above a central portion of said bottom portion, and connected to said air path means, for blowing out the air supplied from said blower through said air path means, from said opening toward said bottom portion.

19. A combustion apparatus according to claim 18, wherein said circular pipe is detachable.

20. A combustion apparatus according to claim 18, further composing:

at least one temperature detector means for detecting a temperature; and control means for controlling said blower to change an amount of air supply in accordance with the detected temperature.

21. A combustion apparatus according to claim 18, further comprising an entrance provided to protrude from said combustion chamber and to have tapered lower portion and having a closure, for throwing an object to be burned into said combustion chamber.

22. A combustion apparatus according to claim 21, wherein said entrance further includes air curtain means provided in at least a portion of said entrance, connected to said blower, and responsive to an operation of said closure, for preventing flame from being blown out from said entrance by the air supplied from said blower when said closure said opened.

23. A combustion apparatus according to claim 18 further comprising:

burner means provided at said bottom portion, for blowing out flame; and collecting means provided at said bottom portion, for collecting ash piled at said bottom portion and blown off by said burner means.

24. A combustion apparatus comprising:

a combustion chamber having a bottom portion;

a blower for supplying air;

air blowing means provided at a lower portion of said combustion chamber, for blowing out the air supplied from said blower toward said bottom portion such that a maximum combustion temperature portion is located in the vicinity of said bottom portion by the blown air, and wherein said air blowing means comprises:

air path means for passing the air from said blower; and a plurality of projection portions having at least one opening on its lower surface, provided on an inner wall of said combustion chamber at a lower portion of said combustion chamber, and connected to said air path means, for blowing out the air supplied from said blower through said air path means, from said opening toward said bottom portion.

25. A combustion apparatus according to claim 24, further composing:

at least one temperature detector means for detecting a temperature; and control means for controlling said blower to change an amount of air supply in accordance with the detected temperature.

26. An incinerator apparatus comprising:

a combustion chamber having a bottom portion; and convection means for making convection to occur in the vicinity of said bottom portion by forced air flow, such that air is moved toward said bottom portion in the center portion of the bottom portion and combustion gas rise upwardly along a wall of said combustion chamber, and wherein said convection means comprises:

a blower for supplying air; and air blowing means provided at a lower portion of said combustion chamber, for blowing out the combustion air supplied from said blower toward said bottom portion, and wherein said air blowing means comprises:

air path means for passing the air from said blower; and a circular pipe having at least one opening on its lower surface, provided above a central portion of said bottom portion, and connected to said air path means, for blowing out the air supplied from said blower through said air path means, from said opening toward said bottom portion.

27. An incinerator apparatus comprising:

a combustion chamber having a bottom portion; and convection means for making convection to occur in the vicinity of said bottom portion of a forced air flow, such that air is moved toward said bottom portion in the center portion of the bottom portion and combustion gas rises upwardly along a wall of said combustion chamber, and wherein said convection means comprises:

a blower for supplying air; and air blowing means provided at a lower portion of said combustion chamber, for blowing out the air supplied from said blower toward said bottom portion, and wherein said air blowing means comprises:

air path means for passing the air from said blower; and a plurality of projection portions having at least one opening on its lower surface, provided on an inner wall of said combustion chamber at a lower portion of said combustion chamber, and connected to said air path means, for blowing out the air supplied from said blower through said air path means, from said opening toward said bottom portion.

28. An incinerator apparatus comprising:

a combustion chamber having a bottom portion;

a blower for supplying air;

blowing means for blowing the air supplied from said blower toward said bottom portion such that convection is caused around said air blowing means;

detecting means provided in said combustion chamber, for detecting a temperature; and control means for controlling said blower in accordance with the detected temperature such that said blower increases or decreases an amount of air to be supplied, and wherein said air blowing means comprises:

air path means for passing the air from said blower; and a plurality of projection portions having at least one opening on its lower surface, provided on an inner wall of said combustion chamber at a lower portion of said combustion chamber, and connected to said air path means, for blowing out the air supplied from said blower through said air path means, from said opening toward said bottom portion.

29. A combustion apparatus comprising:

a combustion chamber having a bottom portion;

a blower for supplying air;

air blowing means for blowing the air supplied from said blower toward said bottom portion such that convection is caused around said air blowing means;

detecting means provided in said combustion chamber, for detecting a temperature; and control means for controlling said blower in accordance with the detected temperature such that said blower increases or decreases an amount of air to be supplied, and wherein said air blowing means comprises:

air path means for passing the air from said blower to at least one first opening provided on a wall of said combustion chamber; and a detachable circular pipe with at least one bridge pipe corresponding to said at least one first opening, said bridge pipe being connected to said first opening, wherein said circular pipe has at least one second opening on its lower surface, and is provided above a central portion of said bottom portion to blow out the air supplied from said blower through said air path means, from said second opening toward said bottom portion.

* * * * *